US005685124A

United States Patent [19]

Jandl, Jr.

[11] Patent Number: 5,685,124

[45] Date of Patent: Nov. 11, 1997

[54] WALL, CEILING OR ROOF ELEMENTS WITH HEAT INSULATION PROPERTIES ON ONE SIDE AND SOUND INSULATION PROPERTIES ON THE OTHER

[76] Inventor: Adolf Jandl, Jr., Hartelsberg 26, A-9421 Eitweg, Austria

[21] Appl. No.: 638,693

[22] Filed: Apr. 26, 1996

Related U.S. Application Data

[63] Continuation of Ser. No. 336,195, Nov. 2, 1994, abandoned.

[30] Foreign Application Priority Data

Apr. 21, 1994 [DE] Germany ..... 44 13 953.5

[51] Int. Cl.[6] ..... E04C 2/02; E04C 2/10; E04C 2/32; E04C 2/36

[52] U.S. Cl. ..... 52/783.11; 52/145; 52/783.17; 52/783.19

[58] Field of Search ..... 52/145, 781.17, 52/783.18, 783.19, 783.11

[56] References Cited

U.S. PATENT DOCUMENTS

| | | | |
|---|---|---|---|
| 2,426,943 | 9/1947 | Morden . | |
| 2,829,403 | 4/1958 | Willatts et al. | 52/783.19 X |
| 4,838,524 | 6/1989 | McKeowen et al. | 52/145 X |

FOREIGN PATENT DOCUMENTS

| | | | |
|---|---|---|---|
| 285129 | 10/1970 | Austria . | |
| 720700 | 9/1968 | Belgium . | |
| 812834 | 9/1951 | Germany . | |
| 835053 | 3/1952 | Germany . | |
| 835 646 | 4/1952 | Germany . | |
| 835646 | 4/1952 | Germany . | |
| 1 434 126 | 11/1968 | Germany . | |
| 1 945 239 | 3/1971 | Germany . | |
| 72 31 411 | 8/1972 | Germany . | |
| 90 15 521.1 | 5/1991 | Germany . | |
| 343484 | 9/1936 | Italy | 52/783.17 |
| 131528 | 5/1929 | Switzerland . | |
| 239496 | 10/1946 | Switzerland . | |
| 494870 | 9/1970 | Switzerland . | |
| 560913 | 4/1944 | United Kingdom . | |
| 607214 | 8/1948 | United Kingdom | 52/783.17 |

*Primary Examiner*—Christopher T. Kent
*Attorney, Agent, or Firm*—Young & Thompson

[57] ABSTRACT

In wall, ceiling or roof elements, whose basic structure consists mainly of wood or wood materials, and which are provided for buildings that are constructed entirely or partly of panel construction, it is proposed in order to achieve good physical building properties and high load-carrying capacities, to fasten a veneer (4, 5) on one or on both sides to the planar ridge surfaces of a folded plate construction (1) made of boards connected in a shear-resistant manner or a folded plate structure made of molded wood materials and to fill the formed empty or hollow spaces with heat-insulating materials (6), covering materials or light concretes with roughened texture, foamed concretes or the like (7), in which the fillings can be provided made of the same or optionally of combinations of different materials and the components thus made available can be provided with corresponding additional inside shells (10, 11) as well as outside shells (12) or floor structures.

5 Claims, 4 Drawing Sheets

WALL, CEILING OR ROOF ELEMENTS WITH HEAT INSULATION PROPERTIES ON ONE SIDE AND SOUND INSULATION PROPERTIES ON THE OTHER

This application is a continuation of application Ser. No. 08/336,195, filed Nov. 2, 1994, now abandoned.

This invention relates to wall, ceiling, or roof elements for buildings of panel construction, which are produced from wood or molded wood materials, and to which a veneer made of wood, wood materials, gypsum plaster boards, cement fiber boards or the like is fastened on one or both sides, in which their hollow spaces are filled with sound- and heat-insulating materials.

Known wall, ceiling or roof elements essentially consist of a wooden frame construction, lined with webs made of wood or wood materials, with veneers applied on both sides, in which the webs correspond to a rectangular board standing upright, whose wide surfaces form a right angle with the veneer. The hollow spaces formed in this way are preferably filled with light mineral fiber insulating materials, plant fiber insulating materials, cork or the like.

The drawback of such elements consists in that with the light insulating materials, good heat and air-borne sound insulating values are achieved, but good structure-borne sound insulating values can be achieved only at increased construction costs, in the form of separate shells, additional weighting of the shells or the like. This means, especially taking into consideration the static load-bearing performance of such elements, a high expense for assembly, which the builder has to make in most cases.

Moreover, known elements are used in particular in one- and two-story construction, since their load-carrying capacity is limited by the arrangement and dimensioning of the web and insulating material that is appropriate with respect to building physics. Otherwise, this results in multistoried construction, in increased construction expense in the form of separate frame and supporting structures, tie-beam layers, rafters or the like, to which known panel elements are suitably connected to avoid too high a number of sonic and thermal bridges in the wall, ceiling or roof elements themselves.

The purpose of this invention is to avoid the drawbacks of the initially-described type and to provide light wall, ceiling or roof elements that can be used in a versatile manner for buildings of panel construction with good sonic and thermal properties, which can be produced industrially at a high production level and must just be connected in a suitable way by the builder. Further, the purpose of this invention is to make available wall and ceiling elements with high load-carrying capacity, which, without significant additional frame or supporting structures, make possible a multistoried method of construction in panel construction, in which the thickness of the components is not greater than in known products.

According to the invention, this object is achieved in that first a folded plate construction (or a folded plate structure) is produced from wood or molded wood materials, which in the end product assumes mainly the static load-carrying function. In the case of wooden boards connected in a shear-resistant manner, the folded plate construction in the cross section corresponds to the contours of right-angled, isosceles triangles. When using molded wood materials, trapezoidal contours, barrel-shell-shaped and sine wave-shaped contours of the folded plate structure are possible in addition to the previously described shape. All folded plate structures or folded plate constructions are provided with plane ridge surfaces, on which the fastening of the veneer can take place, and the corresponding veneer for finished surfaces can be prepared or equipped with additional shells according to requirements.

The hollow spaces produced by the folded plate structure or the folded plate construction can be filled as follows.

Outside wall elements can be veneered on both sides and provided with hollow space fillings so that light heat-insulating materials, such as mineral fiber materials, plant fiber materials, bits of paper, cork, expanded substances or the like, lie outside with the greatest portion per unit area measured in the folded plate structure-ridge surface plane, heavy storage-effective materials with good heat-insulating capacity, such as aerated concrete or concrete-bound expanded clay or the like, or else coverings with sand, gravel, pumice, slag, aerated lava, expanded clay or the like occupy the greatest portion per unit area on the room side.

In the case of apartment dividing walls and inside walls, the installation of corresponding veneer and optionally additional shells and the arrangement of the filling can take place according to local conditions.

In a ceiling element according to the invention with veneer on both sides, all hollow spaces can have been filled with light heat-insulating materials and—in connection with a suitable outside shell—be assembled into a non-insulated roof. Further, such elements proposed according to the invention generally can be used as components delimiting against the outside air, if they are produced with a corresponding veneer and outside shell.

Ceiling elements of this invention that are under an insulated roof as ceiling of the topmost floor can be veneered only on the room side, and the hollow spaces thus formed as well as the empty spaces of the folded plate structure or the folded plate construction on the roof side are filled with heat-insulating materials.

Internal ceiling elements can be embodied in two different types according to the invention.

1.) Internal ceiling elements can consist of a folded plate construction (or folded plate structure) veneered on both sides, whose hollow spaces are filled so that light heat-insulating materials are incorporated in the hollow spaces over the veneer on the room side, while a covering with above-mentioned substances or a filling with aerated concretes, etc. can be provided in the hollow spaces under the upper veneer. Such ceiling elements can have a known floor structure on the top side and be configured ready for covering or painting or with wood panels or the like on the bottom side. This proposed embodiment makes available very stable ceiling elements with large free span lengths.

2. Internal ceiling elements can consist of a folded plate construction (or folded plate structure) veneered only on the bottom side, whose hollow spaces, formed with the veneer, are filled as under point 1., and which are filled up by the builder on the top side with a covering of sand, gravel, etc. The floor structure is made in a known way on the covering material, either with flooring joists, lying at suitable distances on it, with intervening insulating materials and dry jointless floors, chipboards and parquets lying on top of that, or on an impact-sound insulation arranged on it with floors laid in a floating manner. In this proposed embodiment, disadvantageous sound transmission paths to side components can be avoided for structure-borne sound.

An advantage of these wall, ceiling or roof elements proposed according to the invention lies in that on both sides of the folded plate structure or the folded plate construction, empty spaces develop, which allow a filling so that an advantageous composite action with respect to the sonic and thermal properties is made possible by a suitable combination of different insulating materials in connection with the material of the folded plate structure. Materials of different density and composition, such as loose fiber materials, felts, solid bodies, coverings, etc., can be combined with one another, so that both air-borne sound and structure-borne sound insulation and necessary K values and heat-storage-effective masses can be achieved without extra construction expenses.

Further, in this invention, a branching of sound, a longer transmission path between the veneers, and smaller direct sound transmission areas between the webs and the veneer are achieved by the folded plate structure or the folded plate construction than in known wall and ceiling elements with the same load-carrying capacity.

It is also an advantage of this invention that with a high mechanical level of production and low assembly expense to the builder, components for different requirements can be produced with the same basic structure. In particular, if a folded plate structure made of molded wood materials, such as known Oriented Strand Board or veneer-strip wood, is produced and is now provided with corresponding veneer and hollow space filling, components with high carrying capacity are provided, which in the future can make possible much lower costs for a multistoried apartment building than is possible by previously known products.

BRIEF DESCRIPTION OF THE DRAWINGS

In the drawings, embodiments of the invention are represented as examples there is shown in.

DETAILED DESCRIPTION OF THE PREFERRED EMBODIMENTS

Figure 1:
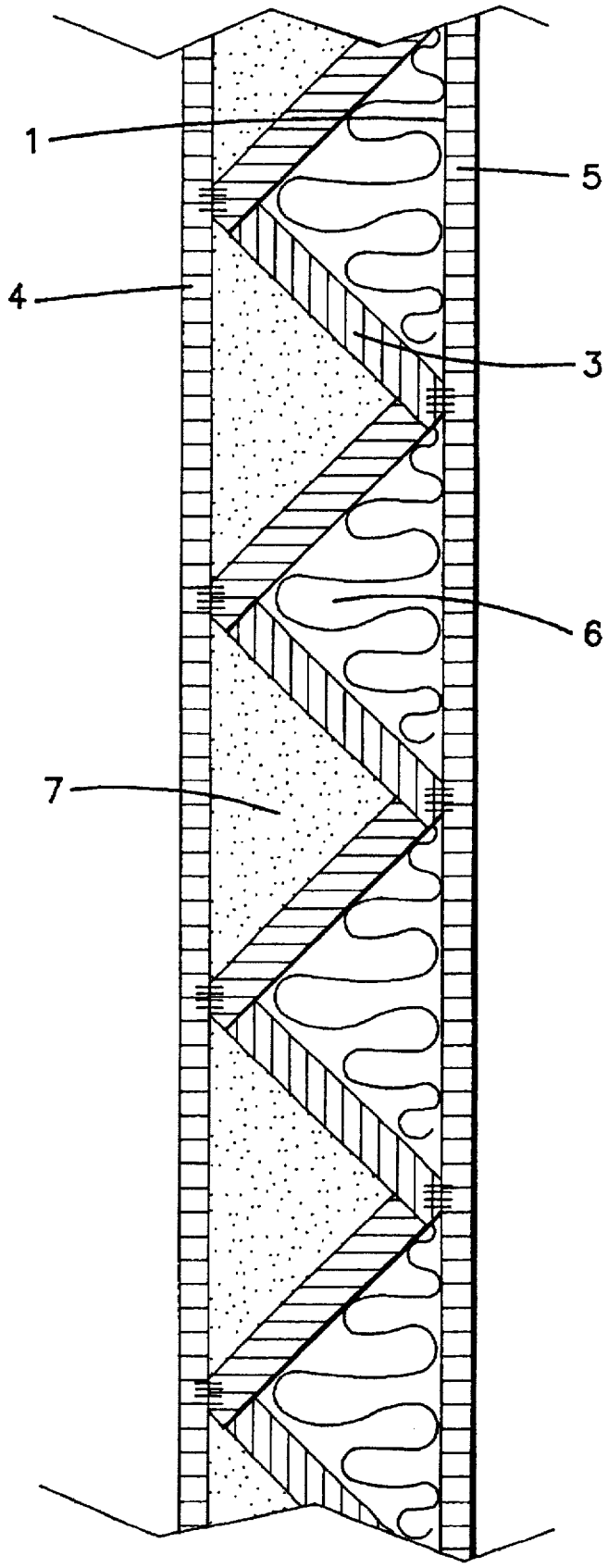
FIG. 1 is a wall, ceiling or roof element according to a first embodiment of the invention, in cross section.

FIG. 1 shows, as an example, a wall, ceiling or roof element, proposed according to the invention, with a folded plate construction 1 made of triangularly smooth-planed boards 3 each provided with a 45° chamfer, which are connected at a right angle by clamps and adhesive. Veneers on both sides (e.g., OSB boards) 4, 5 are bonded to the planar ridged surfaces formed by the chamfers. The hollow spaces formed in this case with veneer 5 are filled with heat-insulating materials 6, the hollow spaces formed with veneer 4 are filled with coverings 7 such as, e.g., sand, gravel, pumice, aerated lava, expanded substances or the like, or else with heavy, wedge-shaped solid bodies made of aerated concretes, concrete-bound expanded clay or the like.

Figure 2:
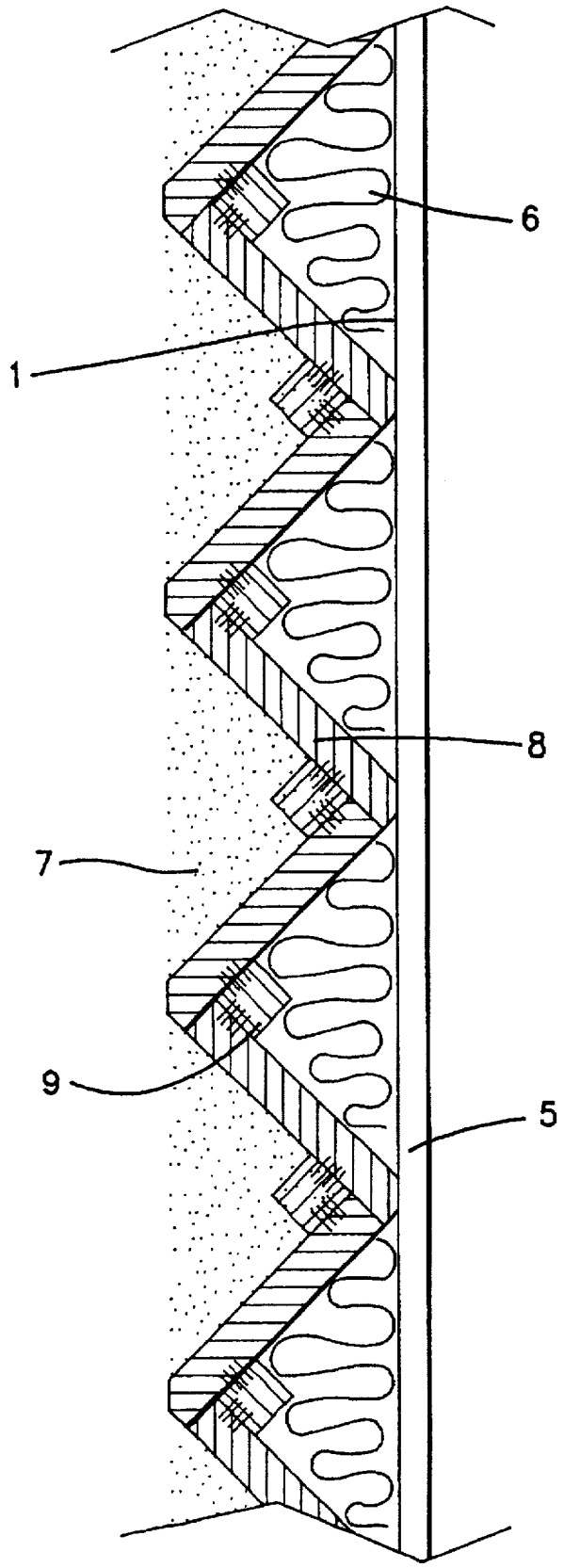
FIG. 2 is a ceiling element according to a second embodiment in cross section.

As another example, FIG. 2 shows an embodiment of the ceiling element, proposed according to the invention, with a folded plate construction 1 made of boards 8 planed on both sides, whose lengthwise narrow sides are made prismatic by two identical 45° chamfers each and are connected at a right angle by angle-rabbeted wooden laths 9, clamps and adhesive, so that two chamfers each form a ridge surface, to which veneer 5 is glued on the bottom side. The hollow spaces formed with veneer 5 are filled with heat-insulating materials 6. The empty spaces resulting on the top side in the folded plate structure are filled up by the builder with heavy covering materials 7, which have good sound-insulating properties and on which a known floor structure can be laid.

Figure 3:
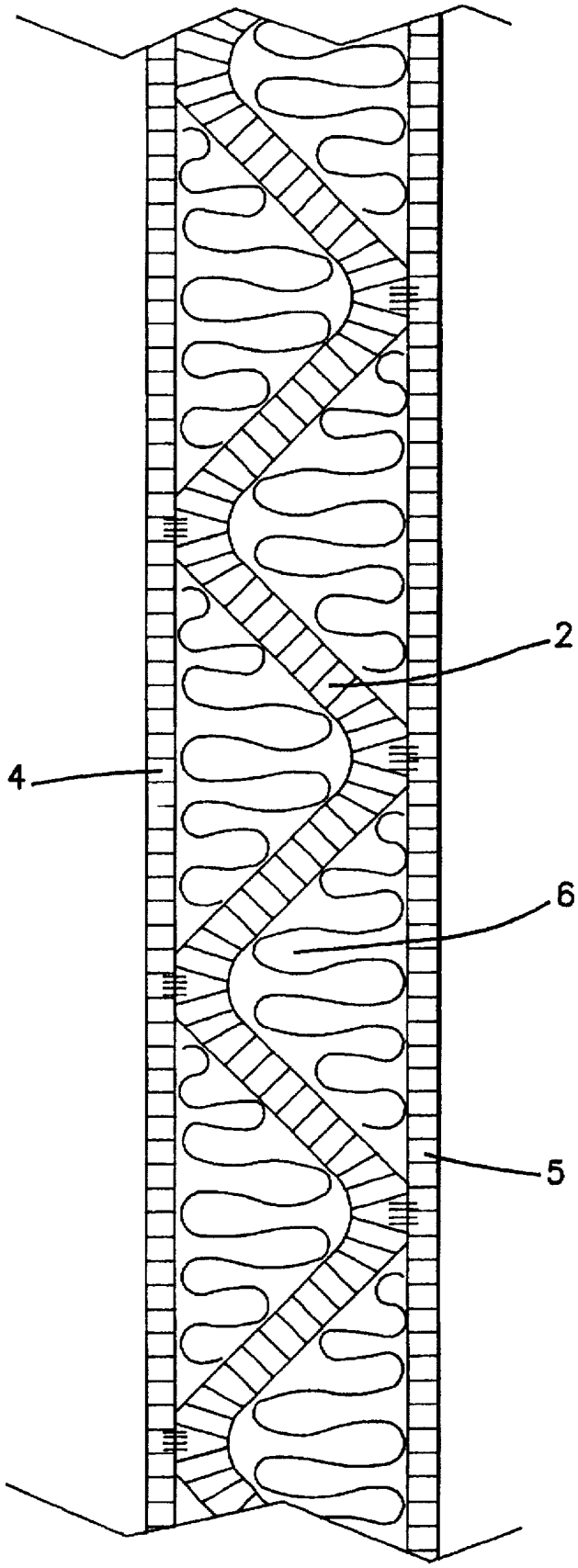
FIG. 3 is a wall, ceiling or roof element according to a third embodiment in cross section.

As an example, FIG. 3 shows a wall, ceiling or roof element in which folded plate structure 2 consists of the basic structure corresponding to the contours of a right-angled, isosceles triangle, in which the valleys corresponding to the technical conditions of mold making are rounded just like the edges of the ridge surfaces.

Folded plate structure 2 is produced in a part of appropriate dimensions from molded wood materials, such as, e.g., OSB, veneer-strip wood or the like with planar ridged surfaces, to which a veneer 4, 5 is glued on both sides. All hollow spaces formed in this way are filled with heat-insulating materials 6. This element, provided with an internal vapor barrier and corresponding outside shell, can be assembled advantageously into a non-insulated roof, or be used as ceiling of the topmost floor under an insulated roof. Further, this element can be used as a heat-insulating, load-bearing wall, if no high sound requirements are set.

Figure 4:
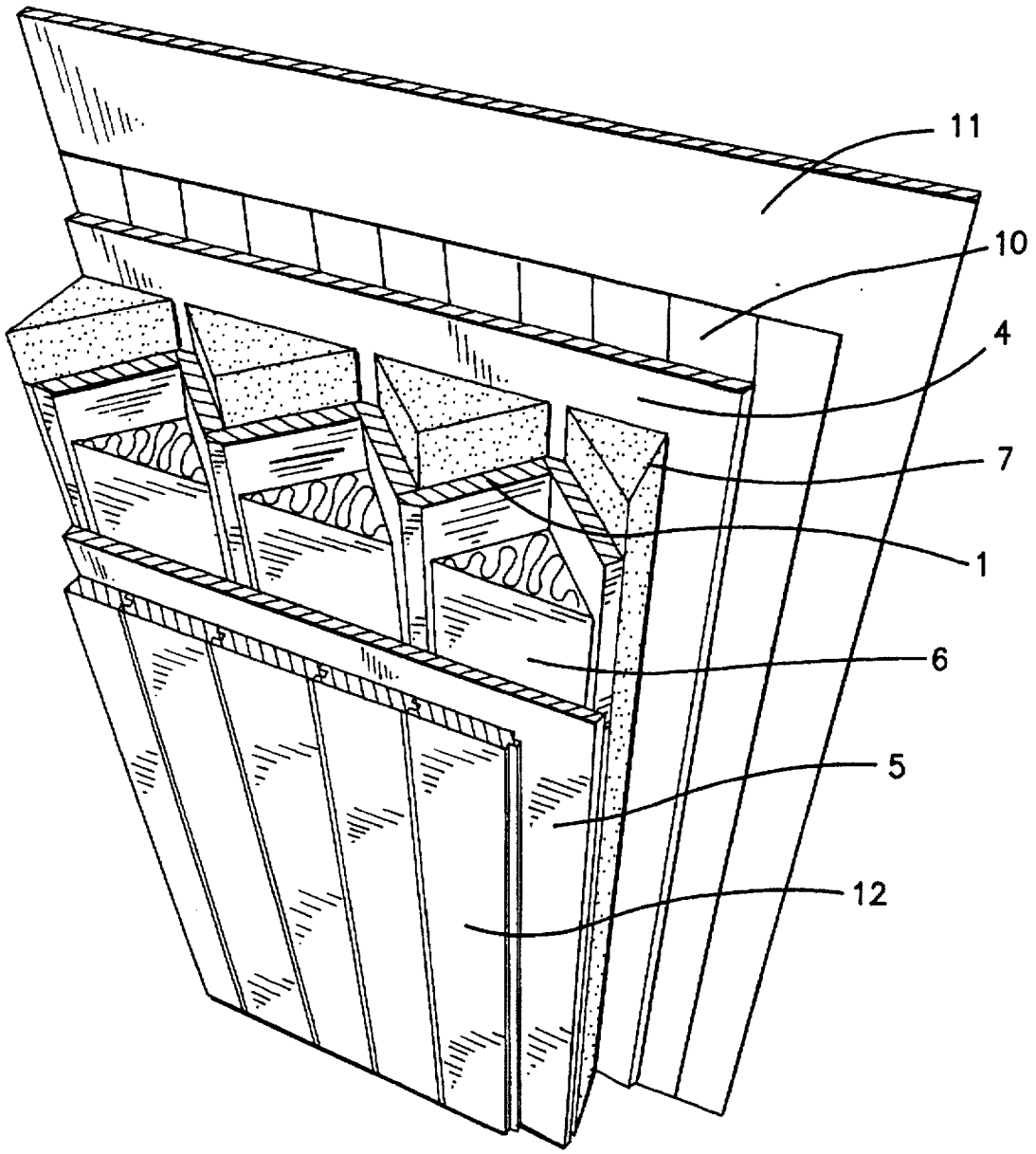
FIG. 4 is a perspective view the structure of a wall element according to the first embodiment with added inside and outside shells.

FIG. 4 shows, as a final example, a wall element, delimited toward the outside, on whose folded plate construction 1 an OSB board (e.g., V100 bond) 5 is bonded on the outside and an OSB board (e.g., V20 bond) 4 is bonded on the room side. The outside shell consists of a nailed-on tongue and groove profile 12 in spruce, the inside shell of a vapor barrier 10 and nailed-on gypsum plaster board 11, which is prepared for a finished surface. In the external hollow spaces, wedges made of mineral wool felt 6 are suitably inserted, correspondingly shaped wedges made of foamed concrete-bound grains of expanded clay 7, preferably with a density>900 kg/m$^3$, are internally fastened with flexible adhesives in the hollow spaces. Heavy foamed concrete elements 7 with favorable heat-insulating values ($\lambda_R$=0.22 W/mK) combined in this way with light heat-insulating materials 6 produce, in addition to good K values (k<0.40 W/m$^2$K) as well as large storage-effective masses, the very advantageous sound-insulating properties of this wall element. A very stable system, in which the total weight of this exemplary wall element is less than 140 kg/m$^2$ and the thickness is 23.5 cm, results from folded plate construction 1 in connection with veneer 4, 5 on both sides.

I claim:

1. Wall, ceiling or roof elements for buildings, wherein a veneer (4, 5) is fastened on at least one side of a plate construction (1), of zig-zag cross-sectional configuration made of wood, and thus-formed hollow spaces are filled with solid insulating materials on both sides of said plate construction, said solid insulating material on one side of the plate construction having better sound insulating properties than the solid insulating material on the other side of the plate construction, and the solid insulating material on said other side of the plate construction having better heat insulating properties than the solid insulating material on said one side of the plate construction.

2. Wall, ceiling or roof elements according to claim 1, wherein said plate construction (1) consists of wooden boards (3), connected in a shear-resistant manner, with 45° chamfers along longitudinal edges of said boards, in which the chamfers form planar ridge surfaces to which the veneer (4, 5) is fastened.

3. Wall, ceiling or roof elements according to claim 1, wherein the plate construction (1) consists of boards (8), which comprise two narrow surfaces having longitudinal edges, the boards being arranged at right angles to one another on both said longitudinal edges, which boards (8) are connected in a shear-resistant manner by angle-rabbeted wooden laths (9) so that the plate construction (1) forms right-angled, isosceles triangles having apices and having at said apices two narrow surfaces which form planar ridge surfaces, to which the veneer (4, 5) is fastened.

4. Wall, ceiling or roof elements according to claim 1, wherein the plate construction has planar ridge surfaces and forms isosceles triangles.

5. Wall, ceiling or roof elements according to claim 1, wherein a veneer (5) is fastened on only one side to the plate construction (1).

* * * * *